United States Patent [19]

Moritz et al.

[11] Patent Number: 4,710,042

[45] Date of Patent: Dec. 1, 1987

[54] METHOD AND APPARATUS FOR INDEXING THE PRINT HAMMER OF TYPEWRITERS OR THE LIKE

[75] Inventors: Manfred Moritz, Nuremburg; Wilfried Rettke, Altdorf, both of Fed. Rep. of Germany

[73] Assignee: Ta Triumph-Adler Aktiengesellschaft, Nuremberg, Fed. Rep. of Germany

[21] Appl. No.: 855,113

[22] Filed: Apr. 23, 1986

[30] Foreign Application Priority Data

Apr. 26, 1985 [DE] Fed. Rep. of Germany ..... 3515108

[51] Int. Cl.[4] ..... B41J 9/14; B41J 1/16

[52] U.S. Cl. ..... 400/141; 400/147; 400/322; 400/328

[58] Field of Search ..... 400/139, 140, 141, 141.1, 400/144, 145, 146, 147, 185, 187, 322, 328; 101/93.15, 93.16, 93.37, 93.43, 93.44, 93.45, 93.46; 178/27, 33 R

[56] References Cited

U.S. PATENT DOCUMENTS

| | | | |
|---|---|---|---|
| 3,422,945 | 1/1969 | Bethune | 400/141 |
| 3,651,914 | 3/1972 | Locke | 401/93.16 |
| 3,688,035 | 8/1972 | Cless | 178/33 R |
| 3,696,204 | 10/1972 | Wallskog | 400/141 |
| 3,927,753 | 12/1975 | Donovan et al. | 101/93.16 |
| 4,436,031 | 3/1984 | Hori | 400/185 |
| 4,461,588 | 7/1984 | Watanabe et al. | 400/185 |
| 4,538,932 | 9/1985 | Takenoya et al. | 400/185 |

FOREIGN PATENT DOCUMENTS

| | | |
|---|---|---|
| 0019453 | 11/1980 | European Pat. Off. . |
| 2901287 | 11/1982 | Fed. Rep. of Germany . |

*Primary Examiner*—Charles A. Pearson
*Assistant Examiner*—David A. Wiecking
*Attorney, Agent, or Firm*—Browdy & Neimark

[57] ABSTRACT

A method and apparatus for indexing the print hammer of typewriters or the like having a carriage supported type matrix positionable in X-Y directions to present a selected character for printing wherein the matrix positioning motor is used to index the hammer in advance of matrix positioning movement.

11 Claims, 4 Drawing Figures

METHOD AND APPARATUS FOR INDEXING THE PRINT HAMMER OF TYPEWRITERS OR THE LIKE

This invention relates to typewriters or like machines having type matrices moveable in X-Y directions to present a selected character in the matrix for printing by a print hammer; more particularly, it relates to a method and apparatus for indexing the print hammer in an inexpensive manner utilizing the type matrix positioning motor.

Typewriters having type matrixes positionable in X-Y directions to present a selected type for impact by a hammer are known to the art. U.S. Pat. No. 3,696,204 is exemplary and discloses a type matrix which is disposed on the rotor of a linear motor and adjustable in X-Y direction and a print hammer magnet on a second rotor of a linear motor and indexable to printing positions independent of the type matrix drive rotor. This known arrangement has the disadvantage that two linear motors, although with the same magnet system, must be present. This leads to a considerable increase in manufacturing costs.

An object of the invention therefore, is in the provision of a method and apparatus which avoids the necessity for a separate positioning drive for the print hammer.

Another object of the invention is in the provision of a single drive for indexing the print hammer carrier and for positioning the type matrix to realize considerable cost savings.

Still another object of the invention is to provide a small inexpensive typewriter having an X-Y positionable type matrix of simple design in which a single linear motor for moving the print hammer to print position and for positioning the type matrix allows simplification of the current supply and circuitry for triggering the linear motor.

A further object of the invention is in the provision of locking means to lock a print hammer in printing position while the type matrix is being positioned.

Other objects, features, and advantages of the present invention will become better known to those skilled in the art from a reading of the following detailed description when taken in conjunction with the accompanying drawing wherein like reference numerals designate like or corresponding elements throughout the several views thereof and wherein.

Figure 1:
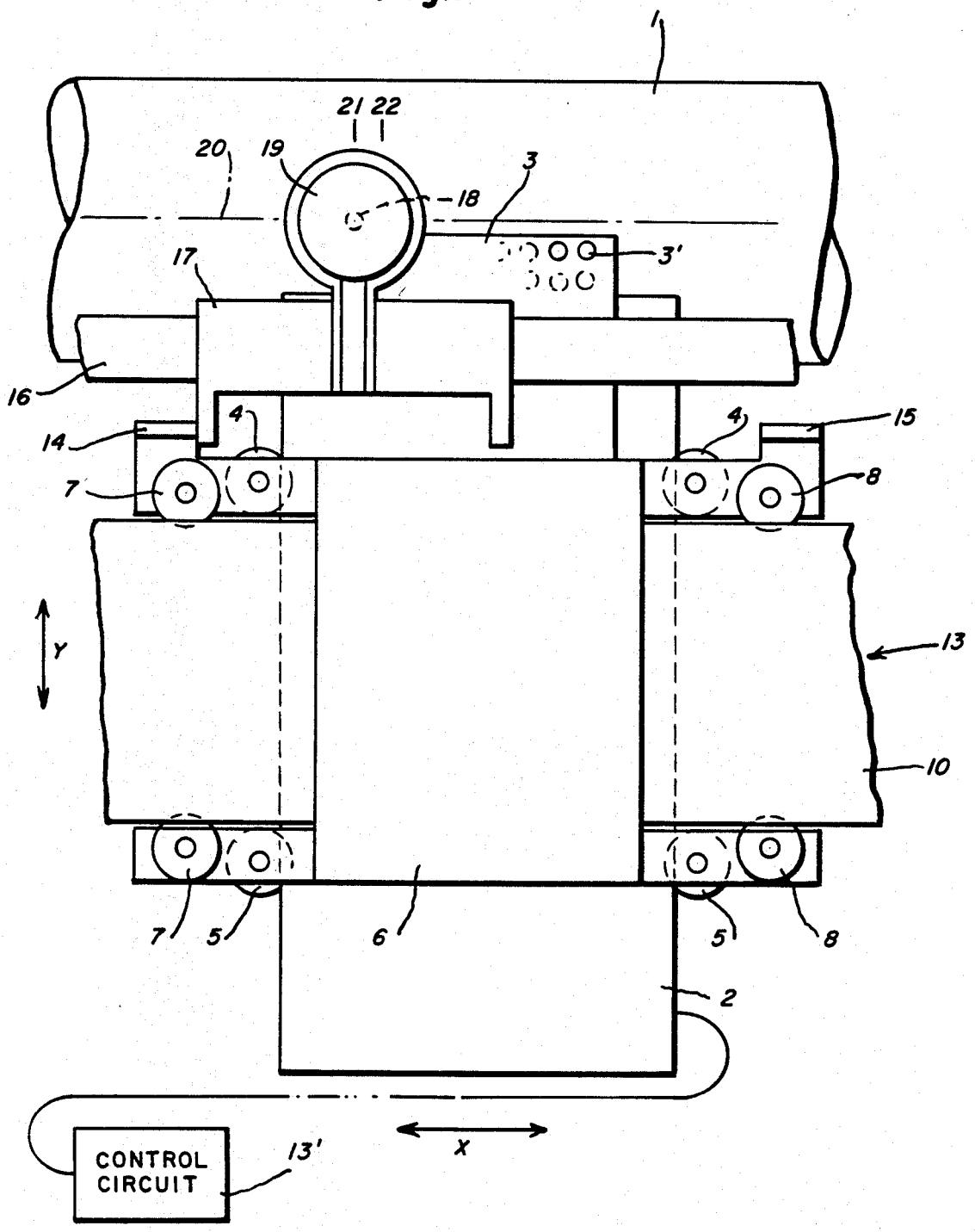
FIG. 1 is a front elevational view of a printing system.

Referring now to the drawing wherein like reference numerals designate like or corresponding parts throughout the several views, there is shown in FIG. 1 a platen 1 to support and line index a sheet of paper. Disposed on the rotor 2 of a linear motor is a type matrix 3 in the form of a columnar (X) and row (Y) positionable rectangle in which the individual types 3' are mounted for movement toward the platen 1. The matrix 3 is positionable to selected coordinates to present character types 3' for longitudinal movement by a print hammer toward the platen 1 against the action of a spring. The type matrix 3 may be constructed, for instance, as shown and described in EP-A1 19 453.

Figure 2:
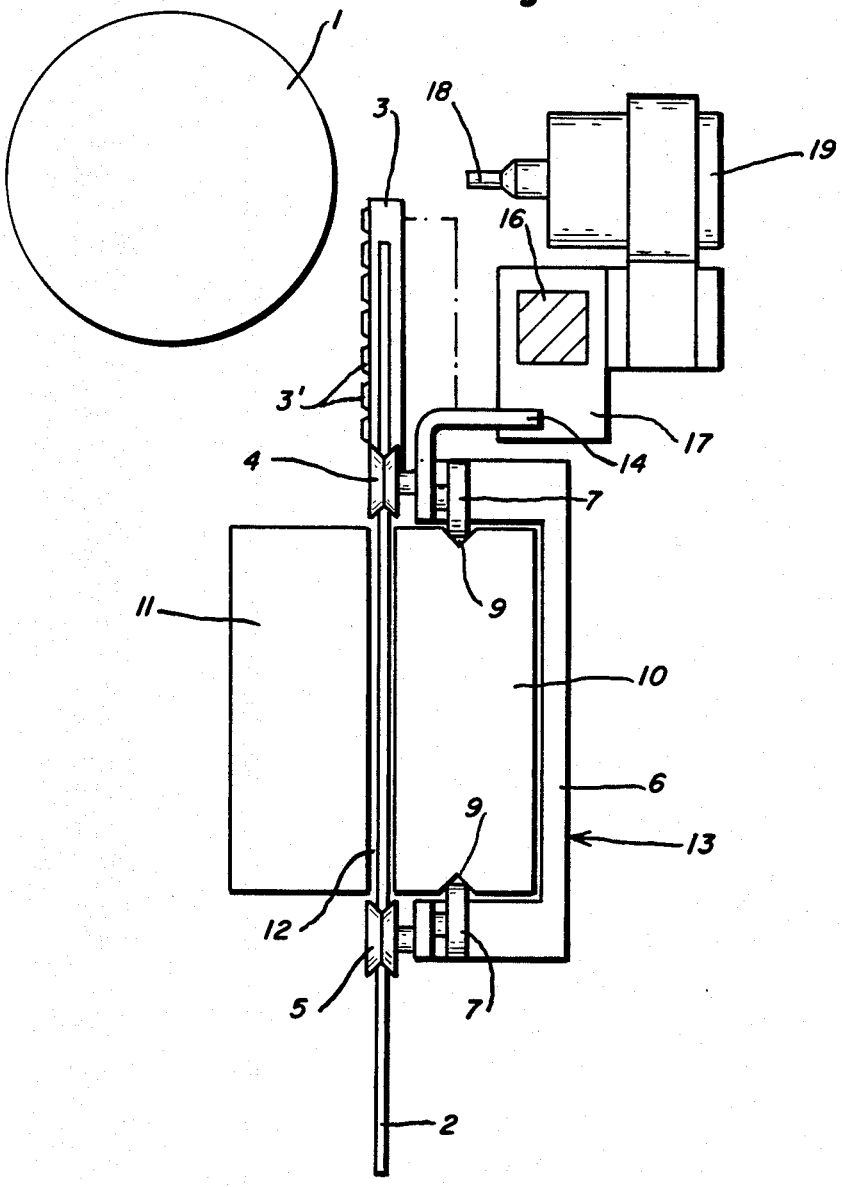
FIG. 2 is a side elevational view thereof.

With reference to FIGS. 1 and 2, the rotor 2 of the linear motor is guided between two pairs of rollers 4 and 5 supported on a rotor driven guide frame 6 for movement in a row or Y coordinate direction. For this purpose, the roller pairs 4 and 5 may have annular V-grooves (FIG. 2) for the exact guidance of the rotor 2. The rotor driven guide frame 6 further rotatably supports two more pairs of rollers 7 and 8 which engage a longitudinal groove 9 (FIG. 2) of one of two machine frame supported magnet carriers 10 and 11 which together define gap 12 in which the rotor 2 is positioned. The magnet carriers 10 and 11 and the linear motor rotor 2 together thus form a linear motor generally designated by reference numeral 13 which can be triggered by signals generated in an electronic control circuit 13' in response to keyboard generated print and function commands. The guide frame 6 can thus be moved in columnar or X coordinate directions by means of the signals generated in the control circuit 13' and applied to the windings of the rotor 2. The linear motor 13 with its rotor 2 provided with the required windings may otherwise be constructed as described and depicted in German Pat. No. 29 01 287, for example.

In addition, with further reference to FIG. 1, there are provided on the guide frame 6, left and right stops 14 and 15, which have forwardly bent out stop tabs. A movable print hammer carrier 17 is disposed between stops 14 and 15 on a stationary guide rod 16. The movable print hammer carrier 17 supports a print hammer 18 and its drive electromagnet 19. The print hammer 18 is disposed so as to be opposite the platen 1 at the level of the printed line, shown in FIG. 1 as a dash-dotted line 20.

The operating mode of the printing system is described in the following; it being assumed that a character in print position 21 was printed on the typed line 20 and that the next character to be printed is to be reproduced in the next following print position 22.

In response to a print command the rotor windings of the linear motor 13 are energized by means of the electronic circuit 13' such that the rotor 2 and the rotor driven guide frame 6 move in direction X, to the right with reference to FIG. 1, by a distance determined by the last selected columnar position of the matrix 3 plus a predetermined distance, corresponding, for instance, to the type pitch, i.e., to the character spacing. The character spacing may be uniform or proportional to the character width according to a microprogram in a microcomputer comprising the electronic motor control circuit 13'.

The movement of the guide frame 6 is operative to bring the stop 14 into engagement with and to move the print hammer carrier 17, and with it also the print hammer 18, along to the right until the print hammer 18 is opposite print position 22. After the print hammer carrier 17 and print hammer 18 have reached print position 22, the control circuit 13' will energize the rotor windings to move the rotor 2 whereby the type matrix 3 can be adjusted in direction X, to the left, to position a selected character 3' opposite the print hammer 18 and, depending on the character to be printed, possibly adjusted in Y-direction without thereby affecting the position of the print hammer carrier 17. When the selected character 3', i.e., the character at the selected X-Y coordinates, is in print position 22 of the typed line 20, the hammer magnet 19 is energized and the print hammer 18 causes the character 3' at the selected coordinates to be driven toward the platen 1 and reproduced.

If the printing system is used in a typewriter, it is necessary to have an unobstructed view of the typed line 20. Towards this end, the control circuit 13' provides for the downward movement of the rotor 2 and the type matrix 3 so that the upper edge of the type matrix 3 is below the typed line 20 by a certain amount to allow an operator an unobstructed view of the typed text. When using the printing system as a printer, where it is unnecessary to view the text while it is being printed, this motion can be omitted.

Before the next character is reproduced, the print hammer carrier 17 is first positioned again to the next print position, then the type matrix 3 adjusted to present a character type 3' for printing in the above described manner, and the print hammer 18 is actuated until a typed line 20 is filled with characters. With the actuation of a carriage return key commonly used in typewriters, a line index signal is generated to line index the paper as by a step motor, and the linear motor 13 is energized so that the rotor 2 is moved to the left with respect to FIG. 1. During this motion the stop 15 encounters and moves the print hammer carrier 17 taking along with it the print hammer 18 until the latter is in the position of the first character to be reproduced on a new typed line 20. This position may be, for instance, all the way at the left margin of the platen 1 or be predetermined by a so-called margin setter. It goes without saying that the housing of the typewriter or printer must be designed so that the rotor driven guide frame 6 and the rotor 2 have enough free space to make this positioning of the print hammer 18 possible.

It is known that linear motors can be operated very fast and with great positioning accuracy. Consequently, the preceding adjustment of the print hammer 18 to the next printing position occurs rapidly. The positioning accuracy of the print hammer 18 and the type matrix 3 also is assured without problem.

Frictional forces between the print hammer carrier 17 and its guide rod 16 may be sufficient to render the locking of the print hammer carrier 17 in the respective reproducing position unnecessary. However, if for reasons of cost, a weaker linear motor 13, which cannot overcome the friction between the print hammer carrier 17 and guide rod 16 is used, provision can be made to lock the print hammer carrier 17 at each new print position. Thus the print hammer carrier 17 can be provided with a pawl engaging corresponding teeth provided on the guide rod 16. In operation the stop 14 on the frame 6 would be operative on the pawl to disengage it from the teeth on the guide rod 16, allowing the print hammer carrier 17 to then be moved by means of the rotor 2. When the stop 14 disengages again from the print hammer carrier 17, the pawl would drop into the teeth, and the print hammer carrier 17 would be locked to the rod 16. Such pawl and tooth detents have been state of the art in the typewriter industry for a long time. However, they generally make possible only one uniform step and, hence, also character spacing.

Figure 3:
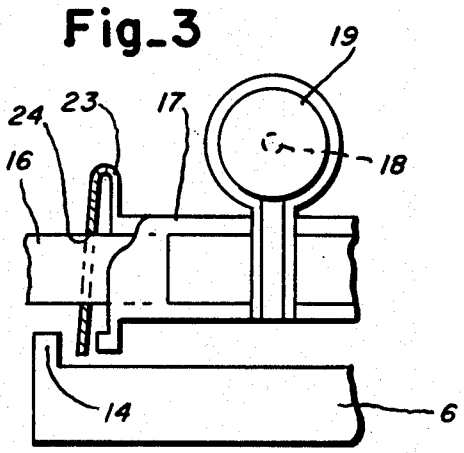
FIG. 3 is a partial front elevational view showing one embodiment for locking the print hammer in printing position.

Referring to FIG. 3 in which the rotor 2 and the matrix 3 are not shown for reasons of clarity, there is shown another type of print hammer carrier locking wherein a spring ring 23 is mounted on the print hammer carrier 17 whose opening 24 is penetrated by the print hammer carriage guide rod 16. Due to the spring action of the ring 23 the unstressed ring 23 positions itself somewhat obliquely so that it is jammed on the guide rod 16 and thus clamped thereto. When the stop 14 is moved to the right with respect to FIG. 3, the clamping action between ring 23 and rod 16 is cancelled out and the print hammer carrier 17 can be adjusted freely to the next printing position, with the locking action re-established automatically after the stop 14 moves away from the ring 23 to position the type matrix 3. Similarly, when stop 15 moves to the left as during a carriage return and encounters and moves the print hammer carrier 17, the clamping action between ring 24 and guide rod 16 is released. This locking mode has the advantage of being simple and costeffective as it does not depend on a gear pitch and further it permits movement of the print hammer carrier 17 by proportional steps. The ring 23 may be produced, e.g., of spring sheet metal or plastic with certain spring characteristics.

Figure 4:
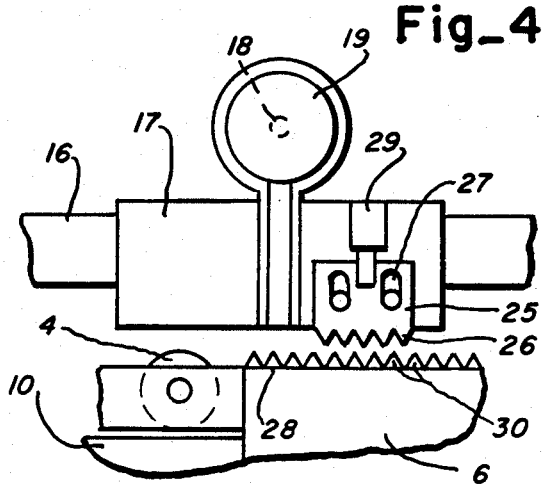
FIG. 4 is a partial front elevational view showing another embodiment of a print hammer locking mechanism.

Referring to FIG. 4 in which again the rotor 2 and type matrix 3 are not shown, another embodiment for indexing the print hammer carrier 17 by means of the rotor guide frame 6 is shown. In this embodiment, stops 14 and 15 on the guide frame 6 are not provided. Instead in this embodiment, the print hammer carrier 17 supports an element 25, having downwardly directed teeth 26 for movement, as by pin and slot connections 27, toward the upper edge 28 of guide frame 6 having teeth 30 formed thereon.

A small electromagnet 29 disposed on the print hammer carrier 17 may serve to move element 25 to bring the teeth 26 into engagement with the matching teeth 30 on the guide frame 6. To couple the print hammer carrier 17 to the guide frame 6 the electromagnet 29 is energized which causes the teeth 26 to mesh with the matching teeth 30 on the guide frame 6. Advantageously, the matching teeth 30 cover a greater width than the teeth 26. This assures that teeth 26 and 30 can mesh in any possible relative position of print hammer carrier 17 and guide frame 6. This design has the advantage that the print hammer carrier 17 and the guide frame 6 can be coupled to move the print hammer carrier 17 to the right to the next typing position immediately after a reproduction of a character without, as in the FIG. 3 embodiment, first having to move the guide frame 6 far enough to the right in direction X for the stop 14 to reach the carrier 17. After moving to the next printing position, the electromagnet 29 is deenergized to release the coupling to allow positioning of the matrix 3 from its last to a new coordinate position to present the next character for printing. In the FIG. 4 embodiment, therefore, the times for positioning the print hammer 18 can thus be reduced and, hence, also the time needed to print a line. The FIG. 4 embodiment is particularly well suited when frictional force is sufficient to maintain the position of the print hammer carrier 17 on the guide rod 16 during positioning of the type matrix.

The method and apparatus described make it possible to dispense with a separate drive for the print hammer carrier 17 with resultant reduction in production costs of a typewriter or printer.

Instead of the type matrix 3 supporting movable type as described, types may be disposed on spring fingers of a comblike type carrier with each individual finger supporting several types. The adjustment of such a type carrier in X and Y direction, however, would be the same.

The invention claimed is:

1. In a typewriter having a print hammer and a type matrix supporting type characters in rows and columns and being positionable to present a character in a selected row and column for printing by the print hammer, the improvement comprising a linear motor having a rotor adapted to be energized to effect movement of said rotor in row and column directions, said type matrix being connected to said rotor, rotor guide means driven by said rotor when energized, a hammer carrier supporting said print hammer, and first means on said guide means and hammer carrier for carrying along said print hammer carrier to position said print hammer to the next printing position when said rotor is energized to move in a columnar typing direction, and for carrying along said print hammer carriage to position it at the beginning of a line of print when said rotor is energized to effect a carriage return.

2. The typewriter of claim 1, including locking means for locking said print hammer carrier at each print position.

3. The typewriter of claim 2, said locking means including a print carrier guide bar, and engaging means on said print hammer carrier normally lockingly engaging said guide bar to preclude print hammer carrier movement.

4. The typewriter of claim 3, comprising said first means on said guide means and hammer carrier for carrying along said print hammer carrier including stop means, and said engaging means lockingly engaging said guide bar being released therefrom when engaged by said stop means incident to movement of said guide means in said typing direction.

5. The typewriter of claim 1, said first means on said guide means and hammer carrier for carrying along said hammer carrier comprising a movable toothed element on said hammer carrier and complimentary teeth on said guide means, and means for moving said movable element to affect engagement of said complimentary teeth to thereby couple the print hammer carrier to the guide means for movement in said typing direction to the next print position.

6. The typewriter of claim 1, wherein, for each said type character to be printed in each said line of print, said first means first provides said carrying along of said hammer carrier to position said print hammer to the next printing position by movement in said typing direction, and subsequently, by motion of said rotor in a direction including a component in an opposite direction, the next respective type character of said type matrix to be printed is aligned with said print hammer.

7. The typewriter of claim 6, wherein the subsequent motion of said rotor for aligning each respective character with said print hammer includes motion in the directions of both said rows and columns, the amount of each depending on the location of each said character in said type array.

8. In a printer having a print hammer, a print hammer carrier supported for movement along a line of print, and a type matrix supported by a rotor of a linear motor movable in X- and Y-directions to present a selected character for printing impact by said print hammer, a method of indexing said print hammer carrier to print positions along said line of print, said method comprising the steps of energizing said rotor to effect movement thereof in a typing direction along the line of print, while using the movement of said rotor in said typing direction to carry along said print hammer carrier to the next printing position, and thereafter energizing said rotor to effect movement thereof opposite said typing direction to position a selected column in the type matrix opposite said print hammer carrier.

9. A method as recited in claim 8, including the step of energizing said rotor to effect movement ot the beginning of a line of print, and using the movement to the beginning of a line of print to carry along said print hammer carrier.

10. The method of claim 9, wherein said energizing of said rotor for said movement opposite said typing direction includes movement of said rotor in both said X- and Y-directions, for printing the respective selected character of said type matrix.

11. The method of claim 8, wherein said energizing of said rotor for said movement opposite said typing direction includes movement of said rotor in both said X- and Y-directions, for printing the respective selected character of said type matrix.

* * * * *